United States Patent [19]

Armstrong et al.

[11] Patent Number: 4,669,224

[45] Date of Patent: Jun. 2, 1987

[54] VERTICAL TO HORIZONTAL ADAPTER FOR A BELT GRINDING MACHINE

[75] Inventors: Archie E. Armstrong, Long Hill; William S. East, Mt. Airy, both of N.C.

[73] Assignee: Westinghouse Electric Corp., Pittsburgh, Pa.

[21] Appl. No.: 881,531

[22] Filed: Jul. 2, 1986

[51] Int. Cl.[4] ..... B24B 21/00

[52] U.S. Cl. ..... 51/135 R; 51/148

[58] Field of Search ..... 51/135, 147, 148

[56] References Cited

U.S. PATENT DOCUMENTS

| | | | |
|---|---|---|---|
| 2,416,493 | 2/1947 | Newton | 51/135 R |
| 2,763,103 | 9/1956 | Bader | 51/135 R |
| 3,024,575 | 3/1962 | Dreiling | 51/135 R |
| 3,619,949 | 11/1971 | Welsch et al. | 51/148 X |
| 3,777,442 | 12/1973 | Bernu | 51/148 X |

FOREIGN PATENT DOCUMENTS

| | | | |
|---|---|---|---|
| 1036502 | 8/1983 | U.S.S.R. | 51/135 R |

*Primary Examiner*—Robert P. Olszewski

*Attorney, Agent, or Firm*—F. J. Baehr, Jr.

[57] ABSTRACT

An adapter for a Bader grinder which permits rapid and easy change from vertical to horizontal grinding wherein the adapter has a quick mounting base portion with two pivoted arms each having a wheel rotatably mounted on the distal end and means for adjusting the angular position of the wheels with respect to the base. The contact wheel is generally oriented horizontally and its support arm is pivotally mounted on the distal end of the base to provide a horizontally moving belt to the workpiece.

10 Claims, 4 Drawing Figures

VERTICAL TO HORIZONTAL ADAPTER FOR A BELT GRINDING MACHINE

BACKGROUND OF THE INVENTION

This invention relates to belt grinding machines and more particularly to an adapter to change the belt from a vertically oriented grinding presentation to a horizontally oriented grinding presentation.

When finishing turbine blades a hand grinding operation is performed on some of the curved surfaces of the blades. The Bader grinder Model 1004A, as manufactured by Steven Bader Company, Inc., 9 Charles Street, Valley Falls, N.Y. 12185, is depicted in FIG. 1 and is utilized to finish turbine blades, however, the belt is oriented for vertical grinding. There are times in finishing the blades where it would be desirable to have the belt oriented for horizontal grinding. The manufacturer was asked to provide a horizontal grinding adapter. Their reply was "turn the machine on its side". While we have done this and the machines operate on their side, they take up too much floor space and changing the machine from one position to another takes too much time.

SUMMARY OF THE INVENTION

A vertical to horizontal adapter for a belt grinding machine having a vertically oriented drive wheel, when made in accordance with this invention, comprises a base portion which attaches to the grinding machine. A first arm pivotally mounted on the base, a generally vertically oriented wheel pivotally mounted on the distal end of the first arm so that the grinding belt is generally horizontally oriented as it runs over the vertically oriented wheel; means for adjusting the angular position of the first arm with respect to the base, a second arm pivotally mounted on the distal end of the base, a generally horizontally oriented contact wheel rotatably mounted on the distal end of the second arm so that a grinding belt is generally vertically oriented as it runs over the generally horizontally oriented wheel, and means for adjusting the angular position of the second arm with respect to the base whereby a grinding belt driven by a vertically oriented drive wheel generally presents a vertically oriented horizontally moving grinding surface to a workpiece.

BRIEF DESCRIPTION OF THE DRAWINGS

The objects and advantages of this invention will become more apparent by reading the following detail description in conjunction with the accompanying drawings, in which.

DESCRIPTION OF THE PREFERRED EMBODIMENT

Figure 1:
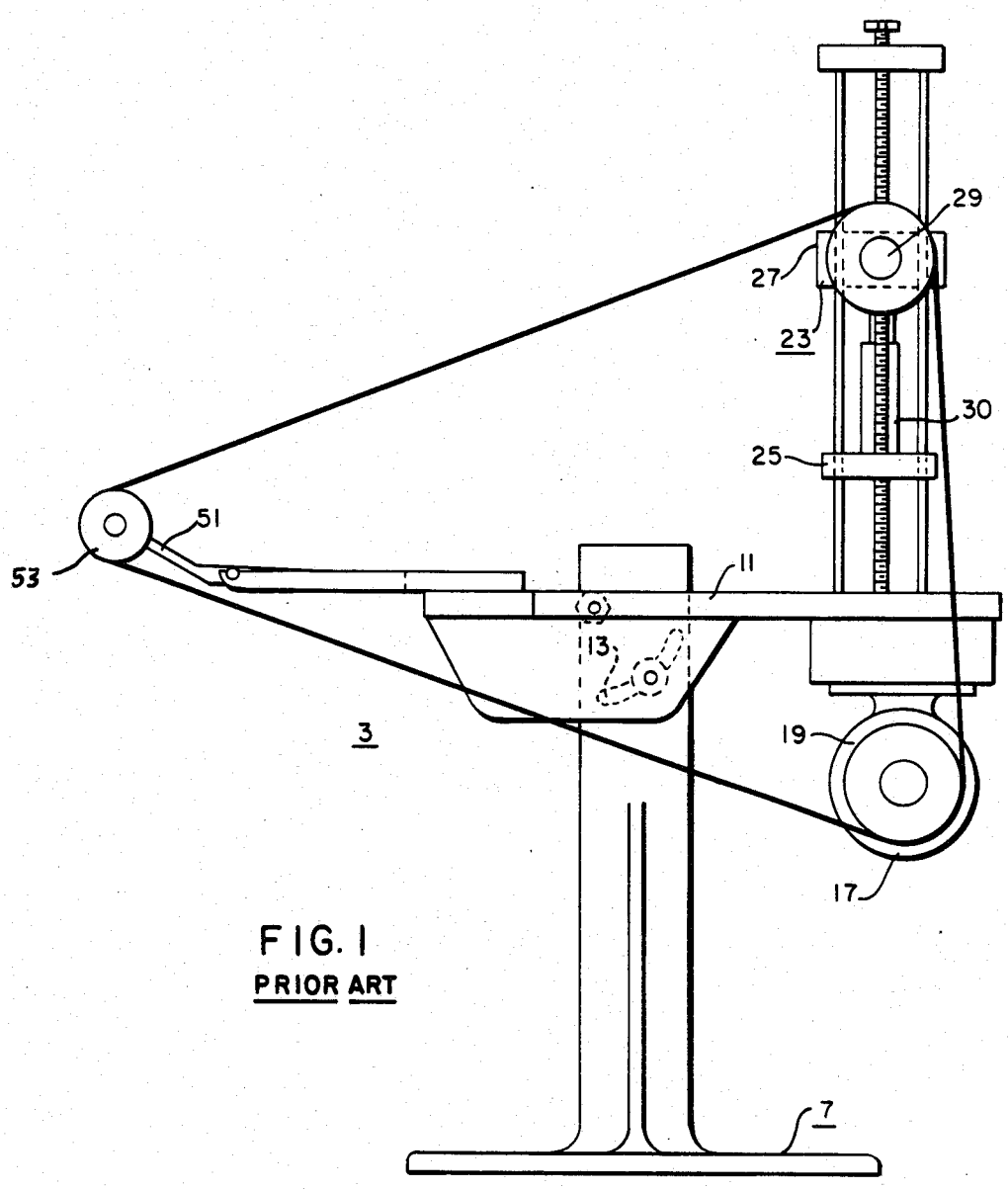
FIG. 1 PRIOR ART
FIG. 1 is an elevational view of a prior art belt grinder.
Figure 3:
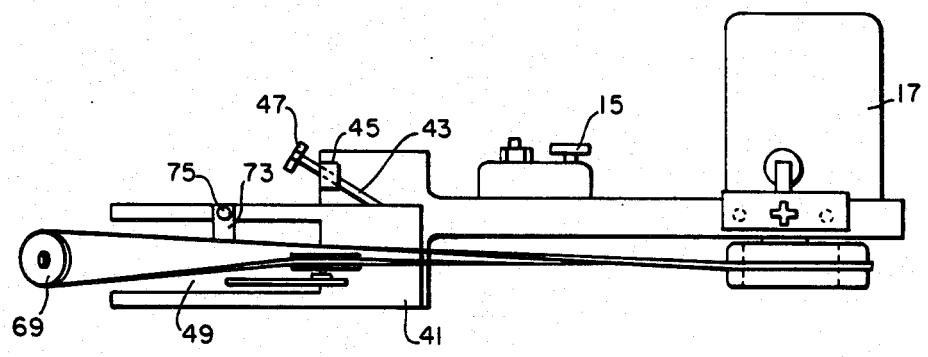
FIG. 3 view of the grinder with the adapter disposed thereon.
Figure 2:
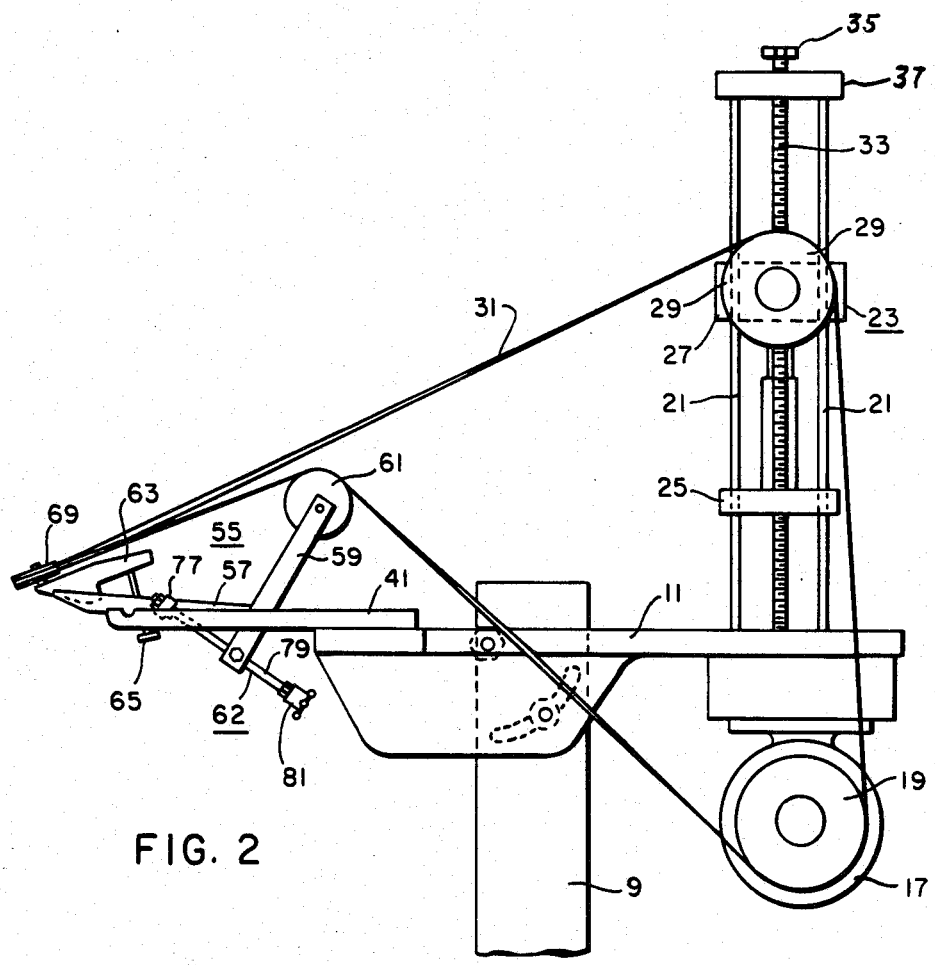
FIG. 2 is an elevational view of the grinder with a vertical to horizontal adapter disposed thereon.

Referring now to the drawings in detail, similar reference numerals throughout the drawings refer to similar items. FIG. 1 shows a prior art grinder 3 while FIGS. 2 and 3 show the grinder 3 with a vertical to horizontal grinder adapter disposed thereon. The grinder 3 comprises a pedestal 7 mounted on the floor (not shown).

The pedestal 7 has an upright portion 9 on which a tiltable bar 11 is pivotally attached to the distal end. The upright portion 9 has an arcuate slot 13 and a stud and hand wheel 15 which cooperate to adjust the angular position of the tiltable bar 11.

A motor drive 17 for a drive wheel 19 is fastened to one end of the tiltable bar 11. Extending upwardly from the motor drive end of the tiltable bar 11 are a pair of guide rails 21 on which an idler carriage 23 is slidably disposed. The idler carriage 23 comprises a first slide bridge 25 slidably disposed on the guide rails 21, a second guide bridge 27 slidably disposed on the guide rails 21, a tensioning wheel 29 rotatably mounted on the second guide bridge 27, a pneumatic cylinder 30, which when activated separates the guide bridges 25 and 27 to tension a grinding belt 31.

A threaded rod 33 is disposed between the guide rails 21 and has a hand wheel 35 on one end and is rotatably attached to an upper bridge 37 attached to the top of the guide rails 21 and engage a threaded hole in the first guide bridge 25 while passing through a hole in the second guide bridge 27 to accommodate different length grinding belts. However, tension on the grinding belt is normally supplied by the pneumatic cylinder 30 as it moves the second grinding bridge 27 with respect to the first grinding bridge 25.

On the end of the tilting bar 11 opposite the motor drive 17 is a wheel mounting pad 41 which is pivotally mounted on the tilting bar 11 so that it generally pivots on a horizontal plane when the tilting bar 11 is horizontally disposed. An angular adjustment screw 43 is pivotally connected to the wheel mounting pad 41, is threaded through a pivot mounting pin 45 which is pivotally mounted on the tilting bar 11 and has a hand wheel 47 affixed to the free end thereof to adjust the angular position of the wheel mounting pad 41 with respect to the tilting arm 11. The mounting pad 41 has a slot 49 which in the prior art shown in FIG. 1 receives a contact wheel arm 51 that is detachably mounted thereon. Rotatably mounted on the distal end of the arm 51 is a contact wheel 53 which receives the grinding belt 31 which runs over the drive, idler and contact wheels 19, 29 and 53, respectively, to present the grinding belt 31 in a vertically oriented grinding position with the belt grinding vertically downward. The grinding machine normally takes a belt 31 that is 132 inches long and ¼ to 3 inches wide. As shown in FIG. 1 the belt 31 is not twisted as it runs generally flat over all of the wheels and the expanses therebetween.

Figure 4:
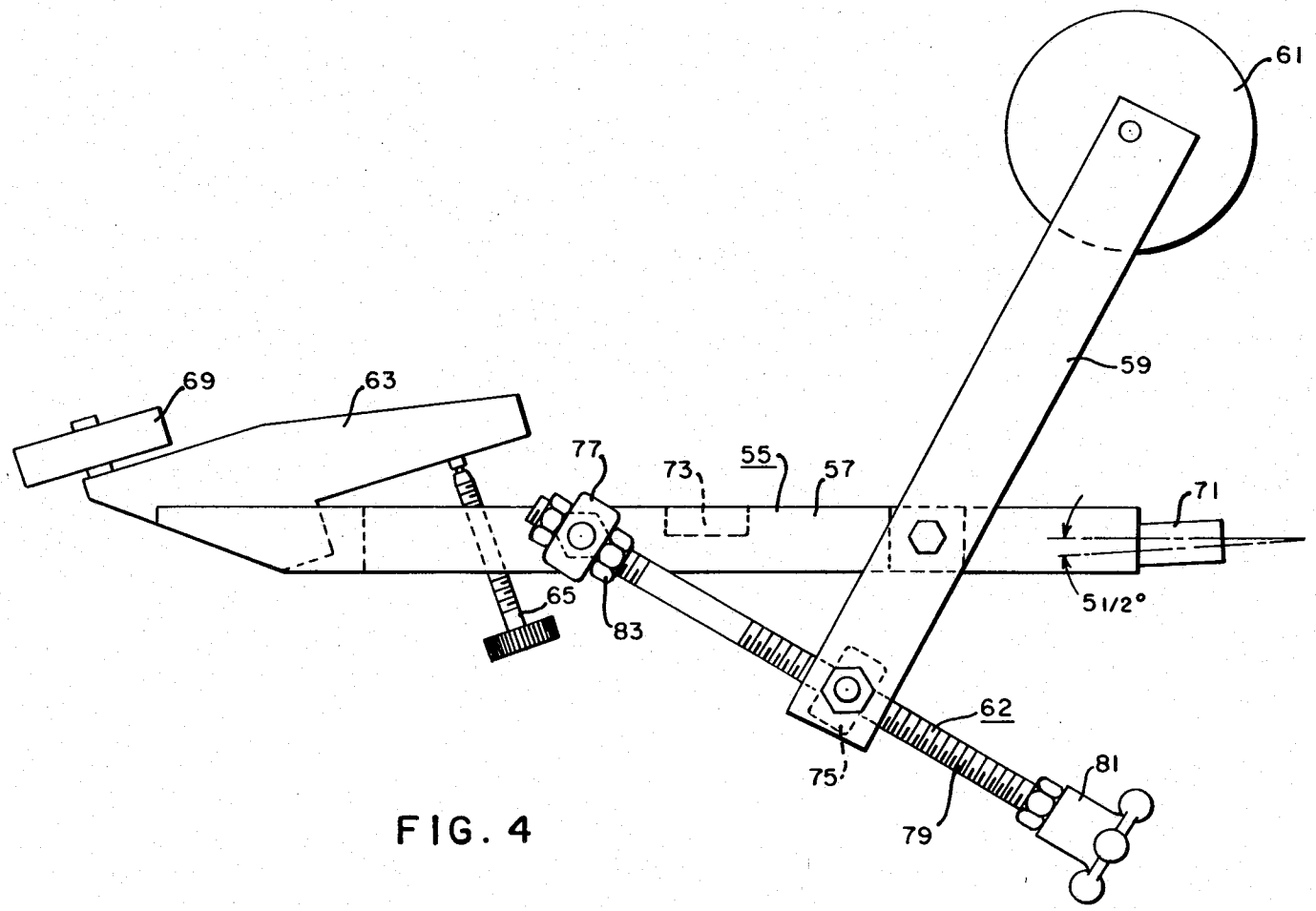
FIG. 4 is an elevational view of the adapter.

To provide for a generally horizontal orientation during the grinding operation, an adapter 55 as shown in FIG. 4, is installed in place of the contact wheel 51 as shown in FIGS. 2 and 3. The adapter 55 comprises a base portion 57 which attaches to the mounting pad 41 which is pivotally mounted to the tilting bar 11. Pivotally mounted on the base portion 57 is a first arm 59 which has a vertically oriented wheel 61 rotatably mounted on one end and means 62 for adjusting the angular position of the first arm 59 with respect to the base 57 mounted adjacent the other end thereof. The angular adjustment means 62 for the first arm comprises a first pivot pin 75 pivotally mounted on the end of the second arm 59 opposite the vertically oriented wheel 61 and has a threaded hole disposed therein, a second pivot pin 77 mounted on the base 57 and having a plain hole disposed therein, a threaded rod 79 with a handle 81 on one end and being threaded through the first pivot pin 75 and passing through the second pivot pin with a nut 83 affixed to the rod 79 adjacent each side of second pin 77.

A second arm 63 is pivotally mounted on the distal end of the base portion 57 and a thumb screw 65 or other means adjust the angular position of the second arm 63 relative to the base portion 57. Rotatably mounted on the other end of the second arm 63, the outboard end, is a horizontally oriented contact wheel 69.

The mounting pad 41 has a hole (not shown) for receiving a turn-down end 71 of the base portion 57. The turn-down end 71 has a centerline which forms an acute angle of about 5½ degrees with the longitudinal axis of the base portion 57 generally causing the base portion 57 to be inclined upwardly as it extends away from the mounting pad 41. The base portion 57 also has an ear 73 which is clamped to the mounting pad 41 by a C-clamp, bolt 75 or other means to prevent the apparatus 55 from rotating with respect to the mounting pad 41. With the adapter 55 in place as shown in FIGS. 2 and 3 the grinding belt which is 132 inches long and ¼ to 3 inches wide runs flat, without any twist, from the drive wheel 19 to the idle wheel or tensioning wheel 29 and is twisted one-quarter turn or 90° in a counterclockwise direction as it runs from the tensioning wheel 29 to the horizontally oriented contact wheel 69, the belt 31 then twists another quarter turn, 90°, in the counterclockwise direction as it runs from the contact wheel 69 to the vertically oriented wheel 61 and then is twisted a half-turn or 180° in the clockwise direction as runs from the vertically oriented wheel 61 to the drive wheel 19.

The adapter 55 hereinbefore described provides for rapid simple setup of the Bader belt grinding machine from vertical to horizontal grinding, the setup time is sufficiently short to change from vertical to horizontal grinding on a single workpiece and the adjustable arms 59 and 63 cooperate with the mounting pad adjustment to allow the 132 inch belt to run over the wheels without coming off even though the belt is twisted three times as it travels over the wheels.

What is claimed is:

1. A vertical to horizontal adapter for a belt grinding machine having a vertically oriented drive wheel rotated about a horizontal axis, said adapter comprising:

a base portion which is attached to said grinding machine;

a first arm pivotally mounted on said base;

a generally vertically oriented wheel rotated about a generally horizontal axis pivotally mounted on the distal end of said first arm so that a grinding belt is generally horizontally oriented as it runs over said vertically oriented wheel;

means for adjusting the angular position of said first arm with respect to said base;

a second arm pivotally mounted on the distal end of said base;

a generally horizontally oriented wheel rotated about a generally vertical axis pivotally mounted on the distal end of said second arm so that a grinding belt is generally oriented to grind horizontally as it runs over said generally horizontally oriented wheel; and means for adjusting the angular position of said second arm with respect to said base whereby a grinding belt driven by a vertically oriented drive wheel generally presents a grinding belt moving horizontally at a workpiece.

2. An adapter as set forth in claim 1, wherein the first arm is pivotally mounted adjacent the central portion of the base.

3. An adapter as set forth in claim 2, wherein the first arm is pivotally mounted adjacent its central portion.

4. An adapter as set forth in claim 3, wherein the angular adjustment means for the first arm comprises a first pivot pin pivotally mounted on the end of the second arm opposite the vertically oriented wheel and has a threaded hole disposed therein, a second pivot pin mounted on said base and having a plain hole disposed therein, a threaded rod with a handle on one end and being threaded through said first pivot pin and passing through said second pivot pin with a nut affixed to said rod adjacent each side of said second pin.

5. An adapter as set forth in claim 4, wherein the angular adjustment means for the second arm comprises an angularly disposed threaded hole in the base and a threaded thumb screw which engages the second arm adjacent the end of the arm opposite the generally horizontally oriented wheel.

6. An adapter as set forth in claim 5 and further comprising means for fixing said base to said machine.

7. An adapter as set forth in claim 1 and further comprising means for fixing said base to said machine.

8. An adapter as set forth in claim 7, wherein the means for fixing said base to said machine comprises a hole in said machine and an end of said base which fits into said hole.

9. An adapter as set forth in claim 8, wherein the end of said base which fits into the hole in the machine has a centerline which forms an acute angle with a longitudinal centerline of the base.

10. An adapter as set forth in claim 8, wherein the base has an ear extending from one side thereof which is attached to the machine.

* * * * *